United States Patent [19]

Watanabe

[11] Patent Number: 4,478,193

[45] Date of Patent: Oct. 23, 1984

[54] CONNECTOR DEVICE FOR USE IN AN INTERNAL COMBUSTION ENGINE

[75] Inventor: Haruo Watanabe, Okazaki, Japan

[73] Assignee: Toyota Jidosha Kabushiki Kaisha, Toyota, Japan

[21] Appl. No.: 460,989

[22] Filed: Jan. 25, 1983

[30] Foreign Application Priority Data

Feb. 18, 1982 [JP] Japan ..... 57-23629

[51] Int. Cl.[3] ..... F02M 7/16

[52] U.S. Cl. ..... 123/489

[58] Field of Search ..... 123/478, 489, 440; 339/176 M

[56] References Cited

U.S. PATENT DOCUMENTS 3,133,777 5/1964 Anhalt ..... 339/176 M X 4,397,279 8/1983 Iida ..... 123/440

*Primary Examiner*—Tony M. Argenbright

*Attorney, Agent, or Firm*—Finnegan, Henderson, Farabow, Garrett & Dunner

[57] ABSTRACT

An engine comprising a fuel injector, an oxygen concentration detector and an electronic control unit. In the electronic control unit, a basic fuel injection time period is calculated, and a correction valve of the basic fuel injection time period is calculated on the basis of the output signal of the oxygen concentration detector. The electronic control unit comprises a back-up RAM storing the mean value of the correction value therein, and an output outputting a voltage which corresponds to the correction value. A connector device is provided, which comprises a connector body and a cap removably fitted onto the connector body. The connector body comprises a output terminal connected to the output of the electronic control unit, a power input terminal connected to the back-up RAM, and a power supply terminal connected to a battery. The cap has a U-shaped connecting terminal which comes into contact with the power input terminal and the power supply terminal for applying an electric power to the back-up RAM when the cap is fitted onto the connector body.

4 Claims, 4 Drawing Figures

CONNECTOR DEVICE FOR USE IN AN INTERNAL COMBUSTION ENGINE

BACKGROUND OF THE INVENTION

The present invention relates to a connector device for use in an internal combustion engine.

An internal combustion engine has been known in which the amount of fuel injected from the fuel injector is controlled on the basis of the output signal of an oxygen concentration detector arranged in the exhaust passage of the engine. In such an engine, the correction value of the basis fuel injection time period is normally calculated from the output signal of the oxygen concentration detector, and the actual fuel injection time period, which is necessary to equalize an air-fuel ratio to the stoichiometric air-fuel ratio, is determined by multiplying the basis fuel injection time period by the correction value. The mean value of the correction value is equal to, for example, 1.0, and the correction value is gradually increased when the oxygen concentration detector produces a leam signal, but the correction value is gradually reduced when the oxygen concentration detector produces a rich signal. When the feedback control of the fuel injection time period is started, a reference value such as 1.0 is put into the correction value, and then, the correction value is increased or reduced from the reference value.

However, if the engine is used for a long time, for example, the metering accuracy of the air flow meter for metering the amount of air fed into the cylinder of the engine deteriorates, and as a result, the output voltage of the air flow meter is offset from the regular output voltage indicating the actual amount of air. At this time, if the output voltage of the air flow meter is offset so that it indicates, for example, the amount of air, which is larger than the actual amount of air, since the basis fuel injection time period calculated from the engine speed and the output signal of the air flow meter becomes longer than a fuel injection time period which is necessary to equalize an air-fuel ratio to the stoichiometric air-fuel ratio, the mean value of the correction value becomes small. However, even if the mean value of the correction value becomes small as mentioned above, or becomes large by any other reason, when the feedback control of the fuel injection time period is started, the correction value is increased or reduced from, for example, 1.0. As a result of this, a problem occurs in that the air-fuel mixture becomes excessively lean or rich immediately after the feedback control is started.

In order to eliminate such a problem, a conventional engine is provided with an electronic control unit containing a back-up RAM therein. In this engine, the mean value of the correction value calculated over a long time is stored in the back-up RAM, and when the feedback control is started, the correction value is increased or reduced from the mean value of the correction value, which is stored in the back-up RAM.

However, in the case where, for example, the air flow meter is exchanged for a new one, the new air flow meter is adjusted so that the mean value of the correction value becomes equal to, for example, 1.0. Therefore, at this time, it is necessary to return again the mean value of the correction value, stored in the back-up RAM, to 1.0. However, in order to change data stored in the back-up RAM as mentioned above, it is necessary to detach the power supply terminal of the back-up RAM from the battery. Consequently, problems occur in that a tool for detaching the power supply terminal of the back-up RAM from the battery is necessary, and it takes a long time for detaching the power supply terminal of the back-up RAM from the battery. In addition, another problem occurs in that, when the power supply to terminal of the back-up RAM is connected again to the battery, it is not completely connected to the battery.

SUMMARY OF THE INVENTION

An object of the present invention is to provide a connector device capable of easily changing data stored in the back-up RAM when, for example, the air flow meter is exchanged for a new one.

According to the present invention, there is provided a connector device for use in an internal combustion engine having a power source, a fuel injector, an oxygen concentration detector detecting the components of exhaust gas, and an electronic control unit calculating a basic fuel injection time period and calculating a correction value of the basis fuel injection time period on the basis of an output signal of the oxygen concentration detector for producing a control signal indicating an actual fuel injection time period of the fuel injector, said electronic control unit having a nonvolatile memory for storing the mean value of the correction value therein, and an output for outputting voltage corresponding to the correction value, said connector device comprising: an output terminal connected the output of the electronic control unit and outputting the voltage corresponding to the correction value; a power input terminal connected to the nonvolatile memory for applying an electric power to the nonvalatile memory; a power supply terminal connected to the power source; a connector body firmly supporting said output terminal, said power input terminal and said power supply terminal; a cap removably fitted onto said connector body and covering said output terminal, said power input terminal, and said power supply terminal; and a connecting terminal firmly supported by said cap and being connectable to said power input terminal, and said power supply terminal for connecting said nonvolatile memory to the power source when said cap is fitted onto said connector body.

The present invention may be more fully understood from the description of a preferred embodiment of the invention set forth below, together with the accompanying drawings.

DESCRIPTION OF A PREFERRED EMBODIMENT

Figure 1:
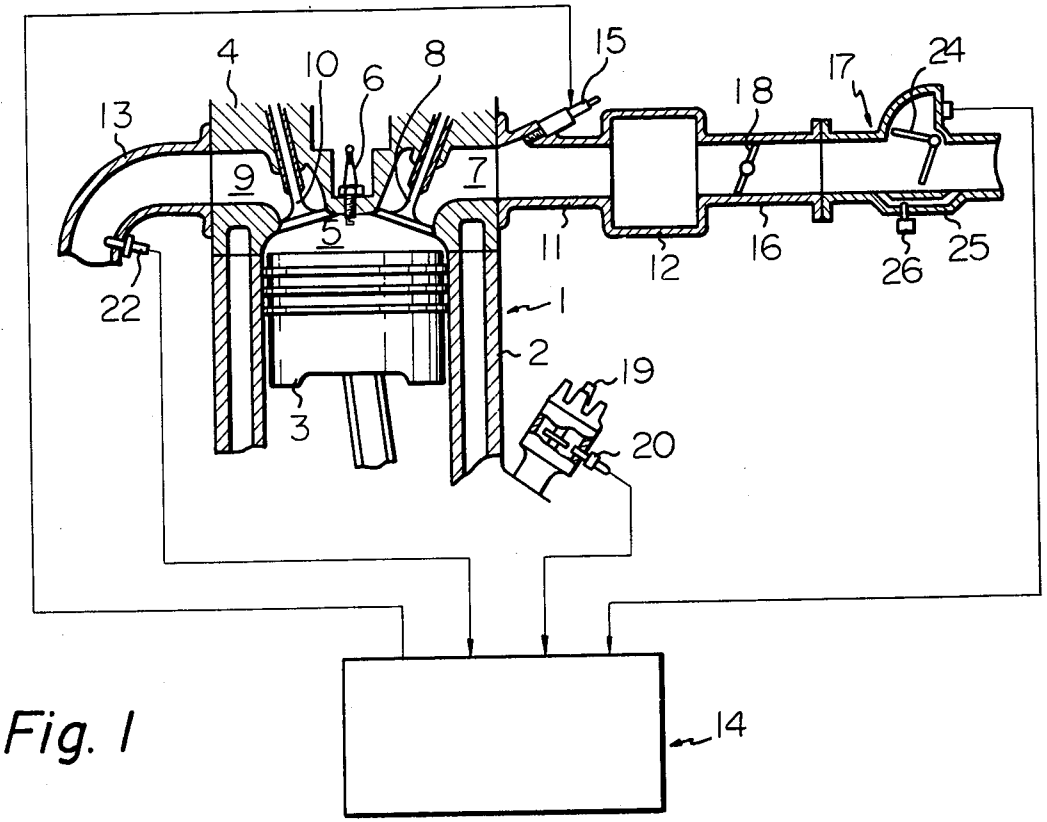
FIG. 1 is a cross-sectional side view of an internal combustion engine.

Referring to FIG. 1, reference numeral 1 designates an engine body, 2 a cylinder block, 3 a piston reciprocally movable in the cylinder block, and 4 a cylinder head fixed onto cylinder block 2; 5 designates a combustion chamber formed between piston 3 and cylinder head 4, 6 a spark plug arranged in combustion chamber 5, 7 an intake port, and 8 an intake valve; 9 designates an exhaust port, and 10 an exhaust valve. The intake port 7 is connected via the corresponding branch pipe 11 to surge tank 12 which is common to all the cylinders, and exhaust port 9 is connected to exhaust manifold 13. Fuel injector 15, which is controlled by electronic control unit 14, is provided for each cylinder and mounted on corresponding branch pipe 11, and fuel is injected into each of intake ports 7 from corresponding fuel injector 15. Surge tank 12 is connected to the atmosphere via intake pipe 16, air flow meter 17, and an air cleaner (not shown). Throttle valve 18 is arranged in intake pipe 16 and connected to an accelerator pedal (not shown) arranged in the driver's compartment. Rotating speed sensor 20, for detecting the rotating speed of the crank shaft (not shown) of the engine, is arranged in distributor 19 mounted on engine body 1, and rotating speed sensor 20 is connected to electronic control unit 14. In addition, oxygen concentration detector 22 is arranged in exhaust manifold 13 and connected to electronic control unit 14. Oxygen concentration detector 22 produces an output voltage of about 0.1 volt, that is, issues a lean signal when the air-fuel ratio mixture fed into the cylinders is larger than the stoichiometric air-fuel ratio, while oxygen concentration detector 22 produces an output voltage of about 0,9 volt, that is, issues a rich signal when the air-fuel ratio mixture fed into the cylinders is smaller than the stoichiometric air-fuel ratio. Air flow meter 17 has metering plate 24 rotating in accordance with an increase in the amount of air, and the rotating angle of metering plate 24 is converted to an output voltage. This output voltage is proportional to the amount of air and is fed into electronic control unit 14. In addition, air flow meter 17 has bypass passage 25 bypassing metering plate 24, and adjusting screw 26 for adjusting the amount of air flowing within bypass passage 25 is arranged in bypass passage 25.

Figure 2A:
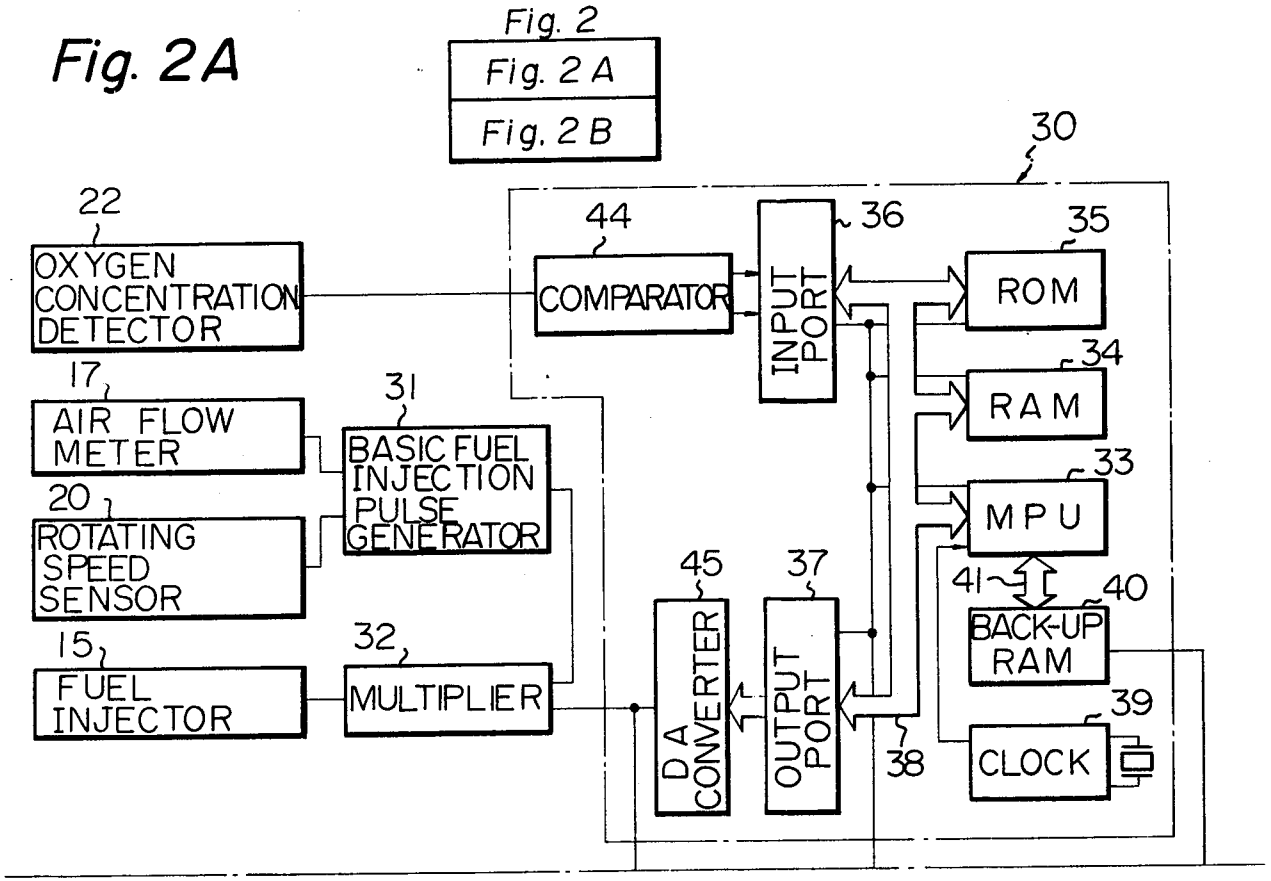
FIGS. 2A and 2B are a circuit diagram of the electronic control unit illustrated in FIG. 1.
Figure 2B:
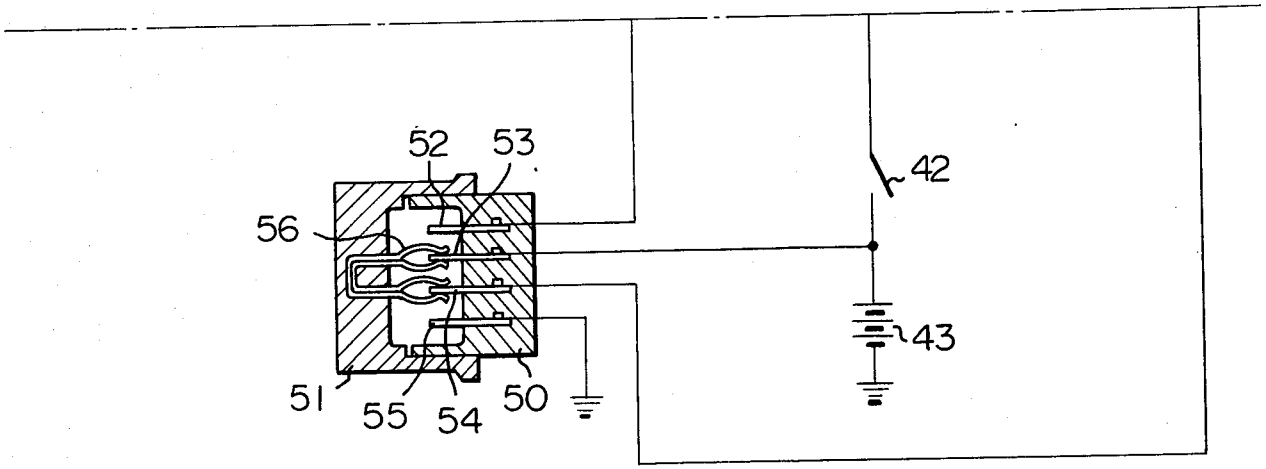

FIG. 2 illustrates electronic control unit 14. As illustrated in FIG. 2, electronic control unit 14 comprises digital computer 30, basic fuel injection pulse generator 31, and multiplier 32. Air flow meter 17 and rotating speed sensor 20 are connected to the input terminals of basic fuel injection pulse generator 31. Basic fuel injection pulse generator 31 produces an output pulse representing the fuel injection time period which is necessary to form the stoichiometric air-fuel ratio. The output pulse is input into one of the input terminals of multiplier 32. Digital computer 30 comprises microprocessor (MPU) 33 carring out the arithmetic and logic processing, random-access memory (RAM) 34, read-only memory (ROM) 35 storing a predetermined control program and arithmetic constant therein, input port 36, and output port 37. MPU 32, RAM 34, ROM 35, input port 36 and output port 37 are interconnected to each other via a bidirectional bus 38. In addition, digital computer 30 comprises clock generator 39 generating various clock signals, and nonvolatile memory 40 such as back-up RAM, and back-up RAM 40 is connected to MPU 33 via bidirectional bus 41. In addition, MPU 33, RAM 34, ROM 35, input port 36, and output port 37 are connected to battery 43 via ignition switch 42.

As illustrated in FIG. 2, oxygen concentration detector 22 is connected to input port 36 via comparator 44. In comparator 44, the output voltage of oxygen concentration detector 22 is compared with a reference voltage of about 0.4 volt. When the output voltage of oxygen concentration detector 22 is lower than the reference voltage, that is, when oxygen concentration detector 22 issues the lean signal, the output voltage, produced at one of the output terminals of comparator 44, becomes high. Contrary to this, when the output voltage of oxygen concentration detector 22 is higher than the reference voltage, that is, when oxygen concentration detector 22 issues the rich signal, the output voltage, produced at the other output terminal of comparator 44, becomes high. The output voltage of comparator 44 is input into MPU 33 via input port 36 and bus 38, and thus, the output signal of oxygen concentration detector 22 is always monitored by MPU 33. On the other hand, output port 37 is connected to one of the input terminals of multiplier 32 via DA converter 45, and the output terminal of multiplier 32 is connected to fuel injector 15.

Actual fuel injection time period T of fuel injector 15 is essentially represented by the following equation.

$$T=T_p \cdot A \cdot F$$

where $T_p$: basic fuel injection time period

F: correction coefficient

A: mean value of the correction coefficient

Figure 3:
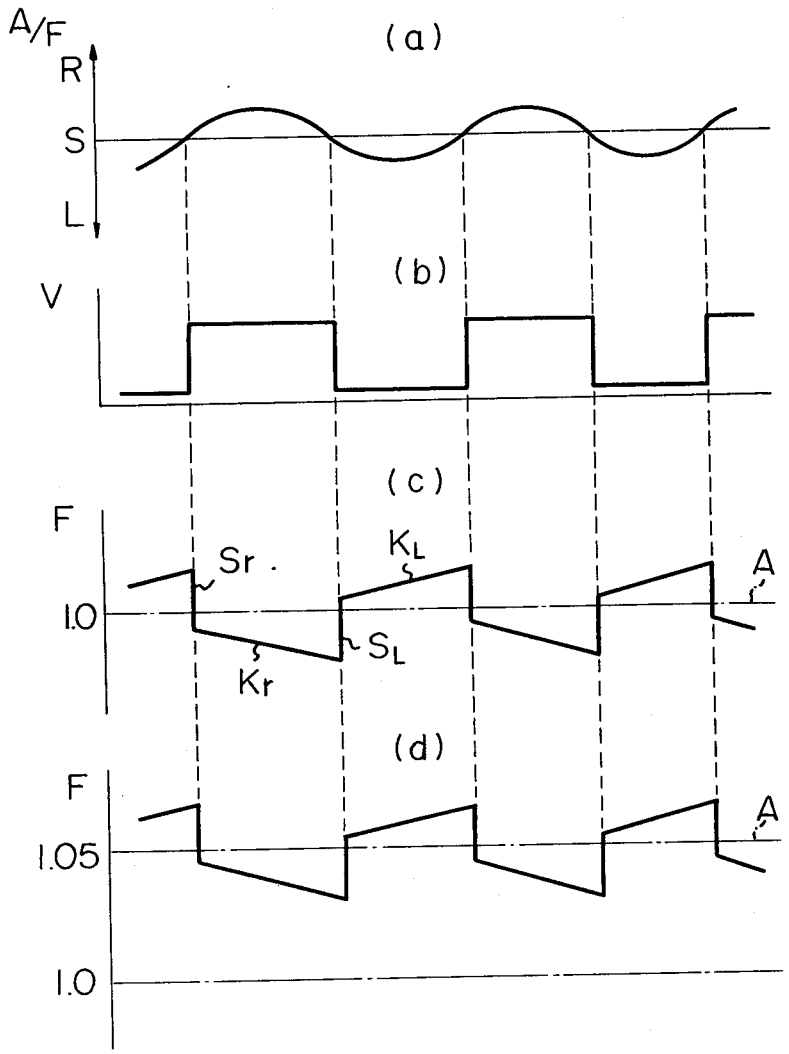
FIG. 3 is a diagram illustrating a change in value of the correction coefficient.

Correction coefficient F and mean value A thereof will be hereinafter described with reference to FIG. 3. FIG. 3 (*a*) illustrates air-fuel ratio A/F. In addition, in FIG. 3 (*a*), R indicates the rich side of stoichiometric air-fuel ratio S, and L indicates the lean side of stoichiometric air-fuel ratio S. FIG. 3 (*b*) illustrates output voltage V of oxygen concentration detector 22, and FIGS. 3 (*c*) and 3 (*d*) illustrate correction coefficient F. As is understood from FIGS. 3 (*a*) and 3 (*b*), when air-fuel ratio A/F is in rich side R, oxygen concentration detector 22, produces the rich signal, and when air-fuel ratio A/F is in lean side L, oxygen concentration detector 22 produces the lean signal. As illustrated in FIG. 3 (*c*), when oxygen concentration detector 22 produces the rich signal, correction coefficient F is instantaneously reduced by predetermined skip degree $S_r$ and then gradually reduced at a speed determined by integration constat $K_r$. Contrary to this, when oxygen concentration detector 22 produces the lean signal, correction coefficient F is instantaneously increased by predetermined skip degree $S_L$ and then gradually increased at a speed determined by integration constant $K_L$. The value of correction coefficient F is calculated in MPU 33. If the air-fuel ratio becomes approximately equal to the stoichiometric air-fuel ratio when fuel is fed from fuel injector 15 in an amount which is determined by basic fuel injection time period $T_p$, mean value A of correction coefficient F becomes equal to 1.0 as illustrated in FIG. 3 (*c*). However, if a lean air-fuel mixture is formed when fuel is fed from fuel injector 15 in an amount which is determined by basic fuel injection time period $T_p$, mean value A of correction coefficient F becomes equal to, for example, 1.05 as illustrated in FIG. 3 (*d*). Mean value A of correction coefficient F calculated over a long time is stored in back-up RAM 40, and data, indicating value A·F obtained by multiplying A by F, is written in output port 37. This data is converted to the corresponding voltage in DA converter 45, and then, in multiplier 35, actual fuel injection time period T is calculated by multiplying basic fuel injection time period $T_p$ by A·F.

Referring to FIG. 2, a connector 50 made of an electrically insulating material, and protecting cap 51 removably fitted onto connector 50 and made of an electrically insulating material are provided. Connector 50 comprises output terminal 52 connected to DA converter 45, power supply terminal 53 connected to battery 43, power input terminal 54 connected to back-up RAM 40, and earthing terminal 55. Terminals 52, 53, 54 and 55 are firmly supported by connector 50. On the other hand, cap 51 is provided with U-shaped connecting terminal 56 which interconnects power supply terminal 53 to power input terminal 54 when cap 51 is fitted onto connector 50 as illustrated in FIG. 2. Connecting terminal 56 is firmly supported by cap 51. When cap 51 is fitted onto connector 50 as illustrated in FIG. 2, back-up RAM 40 is connected to battery 43.

If air flow meter 17 is used for a long time, the output voltage of air flow meter 17 is offset from the regular output voltage indicating the actual amount of air fed into the cylinder of the engine. As a result of this, as mentioned previsouly, mean value A of correction coefficient F is offset from the initial reference value (FIG. 3 (*d*)). However, even if mean value A of correction coefficient F is offset from the initial reference value, since correction coefficient F is increased or reduced from mean value A when the feedback control is started, the air-fuel ratio becomes equal to the stoichiometric air-fuel ratio immediately after the feedback control is started.

On the other hand, when air flow meter 17 is exchanged for new one, initially, the engine is maintained under an idling state. Then, cap 51 is removed from connector 50, and a voltmeter is connected between output terminal 52 and earthing terminal 55. After this, adjusting screw 26 (FIG. 1) of air flow meter 17 is adjusted so that the mean value of the output voltage of DA converter 45 becomes equal to one half of the voltage of battery 43. Such an adjustment results in that mean valve A of correction coefficient F becomes equal to 1.0 as illustrated in FIG. 3 (*c*). When the adjustment of adjusting screw 26 is completed, cap 51 is fitted again onto connector 50. As is understood from the above description, when cap 51 is removed from connector 51, the power supply to back-up RAM 40 is automatically stopped, and thus, mean value A of correction coefficient F, stored in back-up RAM 40, is erased. After this, when cap 51 is fitted onto connector 50, mean value A of correction coefficient F is stored again in the back-up RAM.

In an engine in which the feedback control is carried out on the basis of the output signal of the oxygen concentration detector, after the air flow meter is exchanged for new one, it is necessary to adjust the adjusting screw of the new air flow meter so that the mean value of the correction coefficient becomes equal to 1.0, and it is also necessary to erase data stored in the back-up RAM. In the present invention, when the cap is removed from the connector in order to adjust the adjusting screw of the new air flow meter, since the back-up is automatically disconnected from the battery, it is possible to automatically erase data stored in the back-up RAM.

While the invention has been described by reference to a specific embodiment chosen for purposes of illustration, it should be apparent that numerous modifications can be made thereto by those skilled in the art without departing from the basic concept and scope of the invention.

I claim:

1. A connector device for use in an internal combustion engine having a power source, a fuel injector, an oxygen concentration detector detecting the components of exhaust gas, and an electronic control unit calculating a basic fuel injection time period and calculating a correction value of the basic fuel injection time period on the bases of an output signal of the oxygen concentration detector for producing a control signal indicating an actual fuel injection time period of the fuel injector, said electronic control unit having a nonvolatile memory for storing the mean value of the correction value therein, and an output for outputting voltage corresponding to the correction value, said connector device comprising:

an output terminal connected the output of the electronic control unit and outputting the voltage corresponding to the correction value;

a power input terminal connected to the nonvolatile memory for applying an electric power to the nonvolatile memory;

a power supply terminal connected to the power source;

a connector body firmly supporting said output terminal, said power input terminal and said power supply terminal;

a cap removably fitted onto said connector body and covering said output terminal, said power input terminal, and said power supply terminal; and a connecting terminal firmly supported by said cap and being connectable to said power input terminal and said power supply terminal for connecting said nonvolatile memory to the power source when said cap is fitted onto said connector body.

2. A connector device according to claim 1, wherein said connector body has an earthing terminal firmly supported thereon so that a voltmeter can be connected between said output terminal and said earthing terminal when said cap is removed from said connector body.

3. A connector device according to claim 1, wherein said power input terminal and said power supply terminal are arranged adjacent to each other and extends in parallel to each other, said connecting terminal having a U shape.

4. A connector device according to claim 1, wherein said connector body and said cap are made of an electrically insulating material.

* * * * *